United States Patent [19]

Pruitt

[11] 4,369,580

[45] Jan. 25, 1983

[54] DRAFTING PEN ACCESSORY

[76] Inventor: Richard C. Pruitt, 6509 Ellis Rd., Fort Worth, Tex. 76112

[21] Appl. No.: 141,582

[22] Filed: Apr. 18, 1980

[51] Int. Cl.[3] ..... B43L 13/00

[52] U.S. Cl. ..... 33/42

[58] Field of Search ..... 33/41 R, 41 E, 41 F, 33/42, 39 B, 27 L, 27 K, 41 B, 41 C, 41 D

[56] References Cited

U.S. PATENT DOCUMENTS

| | | | |
|---|---|---|---|
| 1,704,540 | 3/1929 | Keuffel | 33/41 B X |
| 2,782,506 | 2/1957 | Igram | 33/41 R |
| 3,297,003 | 1/1967 | Benson | 33/27 L |
| 3,465,445 | 9/1969 | Fisher | 33/41 R X |
| 3,867,761 | 2/1975 | Abad | 33/41 F |

*Primary Examiner*—Charles E. Phillips
*Attorney, Agent, or Firm*—James E. Bradley

[57] ABSTRACT

An accessory for ink drafting pens that allow parallel curved ink lines to be drawn. The accessory is a guide for use with a conventional template. The accessory has a circular outer surface for rolling contact with the edge of the template. It also has an axial passage for receiving the tubular tip of a conventional drawing pen. The passage is larger than the tip, allowing the guide to tilt toward the template. This provides a clearance between the bottom of the guide and the line being drawn to avoid smearing. The guide's height is selected so that its top slidingly contacts the collar of the pen to limit the amount of tilt.

7 Claims, 7 Drawing Figures

DRAFTING PEN ACCESSORY

BACKGROUND OF THE INVENTION

1. Field of the Invention

This invention relates in general to graphics equipment and in particular to a device for use with a drafting pen to aid in drawing parallel curved lines in ink.

2. Description of the Prior Art

Drawing parallel curved lines in ink is a tedious and time consuming process. Generally the designer or draftsman plots parallel lines in pencil by making many measurements, then connects the short segments in ink by repositioning various templates being employed.

Devices for making parallel curved lines have been proposed, such as those shown in U.S. Pat. Nos. 2,514,003; 3,867,761; 2,782,506; and 3,245,146. These patents disclose devices for use with pencil lead or ball point pens, not ink. Also, certain of these devices would not be suitable for ink since a part of the guide would contact the ink line being drawn, causing smearing. In addition, except for U.S. Pat. No. 2,782,586, all concern specially constructed marking instruments, rather than an accessory for conventional marking instruments.

SUMMARY OF THE INVENTION

It is accordingly a general object of this invention to provide an improved system for making parallel ink lines.

It is a further object of this invention to provide an improved accessory that is operable with a conventional tubular tip ink drawing pen and a conventional template, for making parallel curved lines.

In accordance with these objects, a guide is provided for use with conventional ink drawing pens of the type having a tubular tip depending from a collar. The guide has an axial passage for receiving the tip, and a circular outer surface for rolling contact with the edge of the template. The pen will make a line parallel to the template that is at a distance from the template equal to one half the diameter of the guide. Other guides of different diameters will make parallel lines at different distances from the template.

To avoid smearing of the ink line that is being drawn, the passage for the tubular tip is enlarged so as to allow the device to tilt when it is pressed toward the template. This lifts from the paper all of the bottom but for the portion in contact with the template, thus avoiding smearing. The top is in sliding contact with the collar to limit the tilt.

DESCRIPTION OF THE PREFERRED EMBODIMENT

Figure 1:
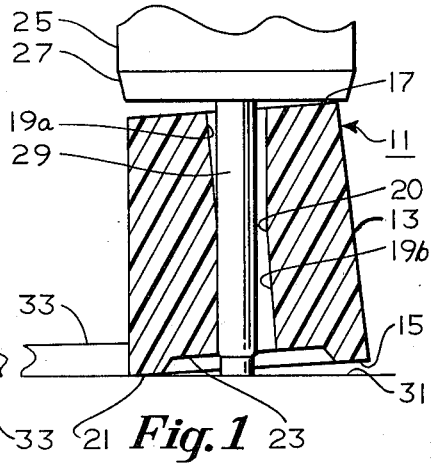
FIG. 1 is a vertical sectional view of a small diameter guide constructed in accordance with this invention and shown in use.

Referring to FIG. 1, a small diameter guide 11 is shown. Guide 11 has an outer surface 13 that is a frustum of a cone, having a larger diameter bottom 15 than the top 17. The difference between the diameters of the top 17 and bottom 15 provides a taper of about three degrees. Guide 11 has an axial passage with an upper converging portion **19*a* and a lower diverging portion 19*b*. The upper portion 19*a* is coaxial with the lower portion 19*b* and intersects the lower portion 19*b* at midpoint 20, a point of minimum diameter for the passage. From midpoint 20 upward, the diameter of passage portion 19*a* increases. From midpoint 20 downward, the diameter of passage portion 19*b* increases. The taper of the lower portion 19*b* equals the taper of the outer surface 13**, thus these surfaces are parallel with each other.

The top 17 is circular and lies in a plane that is perpendicular to the axis of the passage portions **19*a* and 19*b*. The bottom 15 has a circular rim 21 at the periphery that lies in a plane parallel with top 17. Bottom 15 has a circular recess 23 bounded by the rim 21. The width of the rim 21 is about $\frac{1}{4}$ the radius of the bottom 15. Guide 11** is preferably formed of a transparent plastic material.

In the operation of guide 11, a conventional drawing pen 25 is used. Pen 25, as shown also in FIGS. 4 and 6, has a collar 27 from which a tubular tip 29 depends downwardly. Tip 29 carries a needle (not shown) that releases ink when the needle is pressed against a sheet of paper 31. A conventional template 33 serves to define the lines to be drawn. The diameter of the passage portions **19*a* and 19*b* at the midpoint 20, is selected to be larger than the diameter of the largest tubular tip 29 expected to be used. The height of the guide 11 is selected so that the guide 11 can be tilted at about a three degree angle, as shown in FIG. 1**.

By pressing the guide tightly against the template 33, the outer surface 13 tilts toward and forms a mating, linear and rolling contact with the template 33. The outer surface 13 at the line of contact with template 33 will be vertical and parallel with the edge of the template. At the same time, the top 17 contacts the bottom of collar 27, limiting the extent of the tilt, and preventing the guide 11 from riding up. Because the passage lower portion **19*b* has the same taper as the outer surface 13, a portion of the tubular tip 29 will be parallel with and in linear, sliding contact with passage portion 19*b***.

As the pen 25 is traversed along the edge of the template 33, the guide 11 will rotate, while the pen 25 places an ink line parallel to the edge of the template 33 at a distance equal to one-half the diameter of bottom 15. During rotation, the lower passage portion **19*b* will be in sliding linear contact with the tip 29, while the outer edge of the top 17 will be in sliding point contact with the bottom of collar 27. The tilt provides a clearance between the bottom 15 and the paper 31 at the point where the ink line is drawn, avoiding smearing of the ink. The only point of contact with the guide 11 and the paper 31 is a small portion at the edge of template 33**.

Figure 2:
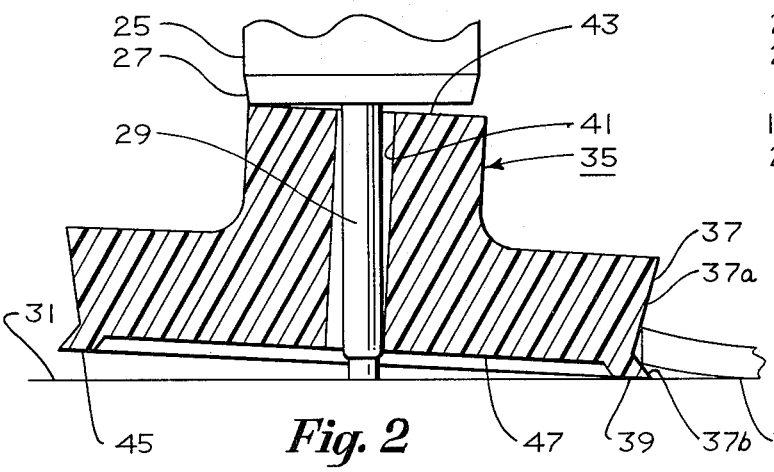
FIG. 2 is a vertical sectional view of a medium diameter guide constructed in accordance with this invention and shown in use.
Figure 3:
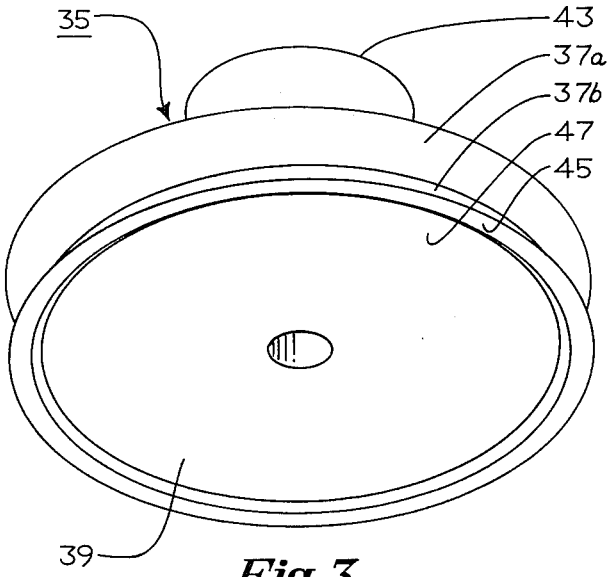
FIG. 3 is a perspective view, as seen from the bottom, of the guide of FIG. 2.
Figure 4:
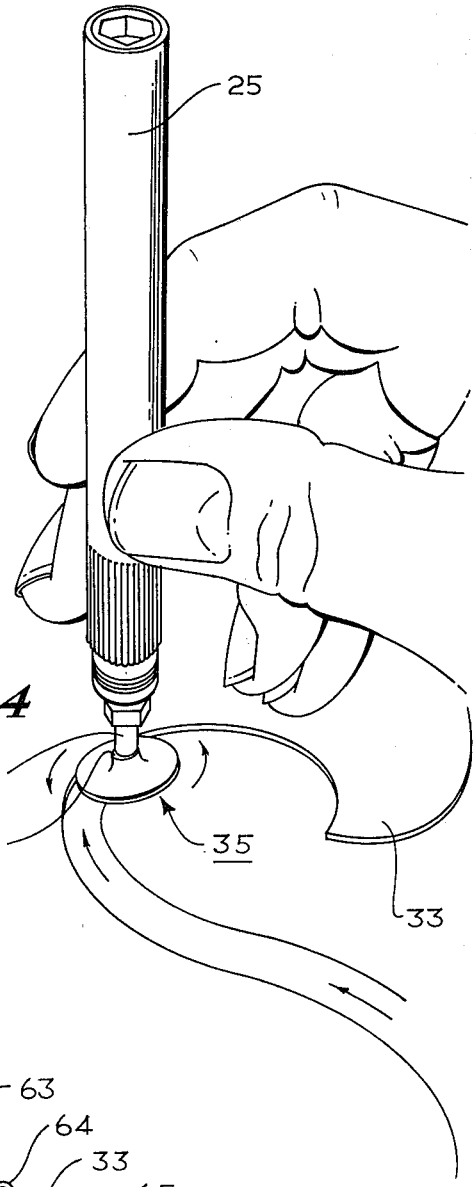
FIG. 4 is a perspective view of the guide of FIG. 2, shown in use.

Guide 11 may be considered a small diameter guide having a diameter at bottom 15 that is less than its height. For placing lines further from template 33, and requiring a guide diameter that is greater than its height, a medium or intermediate diameter guide 35 as shown in FIGS. 2–4 is preferred. Guide 35 has an outer surface 37 that is circular and contains a groove for improved retention with template 33. In this case, the groove is formed by an upper surface 37*a* that is a frustum of a cone with a diameter larger at the top than at the bottom. The upper surface 37*a* intersects a lower surface 37*b* that is a frustum of a cone with a larger diameter at the bottom 39. A minimum diameter portion is located at the intersection of the two surfaces 37*a* and 37*b*.

Guide 35 has an axial passage 41 that is cylindrical and of a larger diameter than tubular tip 29. The diameter should be sufficiently larger so as to allow a three degree tilt of the bottom 39 with respect to the paper 31, as shown in FIG. 2. Guide 35 has a top 43 that is circular and lies in a plane perpendicular to the axis of passage 41. The bottom 39 has a circular rim 45 at the periphery that lies in a plane parallel with top 43 and has a width substantially less than the diameter of the bottom 39. Bottom 39 also has a circular depression or recessed portion 47 bounded by the circular rim 45.

In the operation of the medium diameter guide 35, the tubular tip 29 will make a point sliding contact with a portion of passage 41 at its lower end to urge it laterally against template 33. Template 33 will ride up slightly from paper 31 and locate within the groove formed by the surfaces 37*a* and 37*b*. Guide 35 will tilt toward the template at about three degrees from horizontal. The height of guide 35 is selected so that a portion of top 43 will be in point sliding contact with the collar 17 to limit the tilt. As shown in FIG. 4, as the draftsman moves the pen along the edge of template 33, the guide 35 rotates, forming a rolling contact with template 33, and a sliding contact with the drawing pen 25. The clearance below the bottom 39 avoids smearing of the ink.

Figure 6:
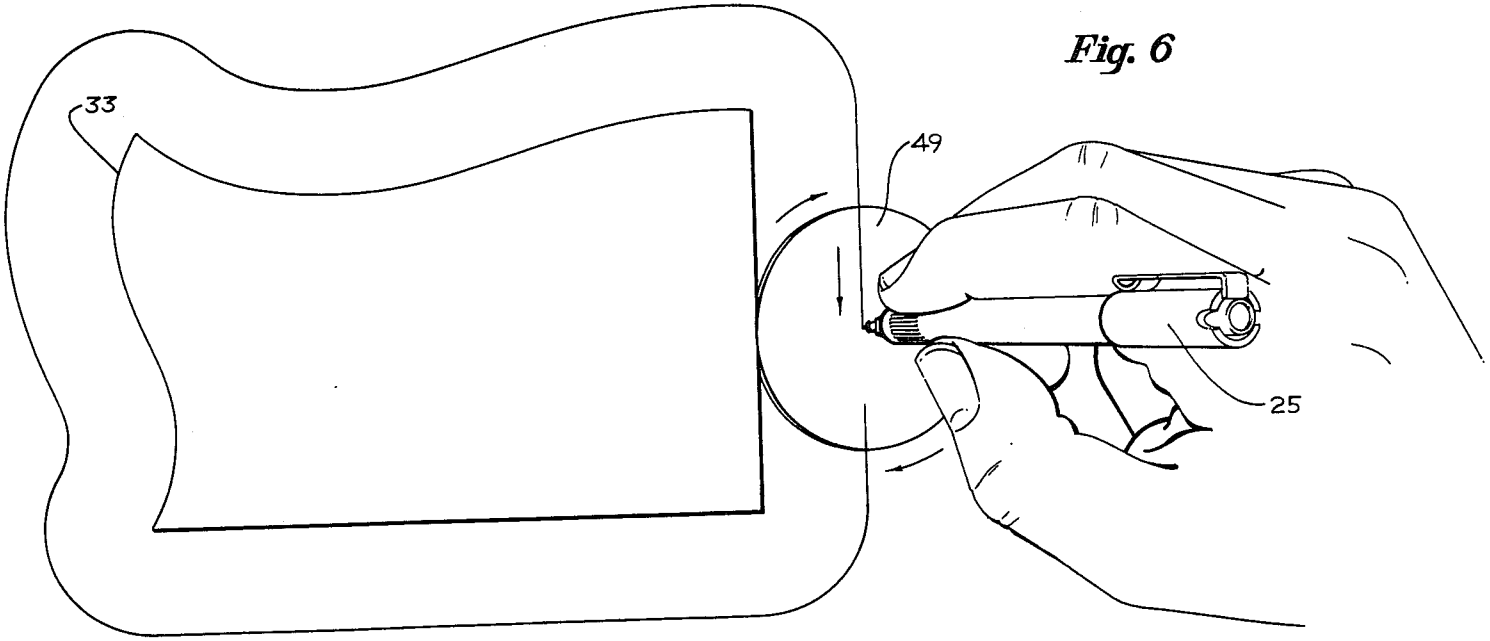
FIG. 6 is a top view of a large diameter guide constructed in accordance with this invention and shown in use.
Figure 7:
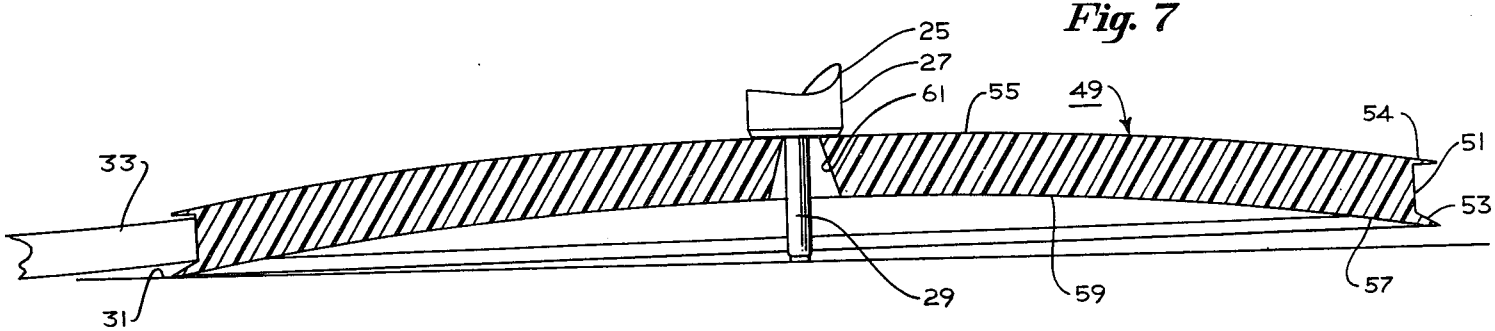
FIG. 7 is a vertical sectional view of the guide of FIG. 6.

The medium diameter guide will also operate in relatively large diameters. FIGS. 6 and 7 disclose a slightly different version that is preferred for larger diameters. Guide 49 has a cylindrical outer surface 51. Guide 49 preferably has a beveled lower edge or lip 53 and a lip or upper edge 54 to securely retain a template 33. Its top 55 may be convex if desired. Its bottom 57 has a concave recess 59 bounded by the beveled edge 53. Guide 49 has axial passage 61 that is diverging, with a diameter at the top 55 that is smaller than its diameter at the recess 59. Passage 61 is preferably conical, and has a larger diameter at top 55 than the largest tubular tip 29 expected to be used.

As shown in FIG. 6, the guide 49 is operated similar to the medium guide 35 and the small guide 11. Tip 29 is inserted through passage 61 and pressed toward template 33. This causes template 33 to ride up slightly and engage the circular outer surface 51, the upper and lower beveled edges 53 and 54 defining a groove to retain the guide 49 within the edge of the template 33. The pen is held vertically and moved parallel to the edge of the template 33. Guide 49 will tilt about three degrees, providing a clearance between the bottom 57 and paper 31, to avoid smearing. The height of guide 49 is selected so that when tilted three degrees, the top 49 will be in contact with the bottom of the collar 27, to limit the tilt.

Figure 5:
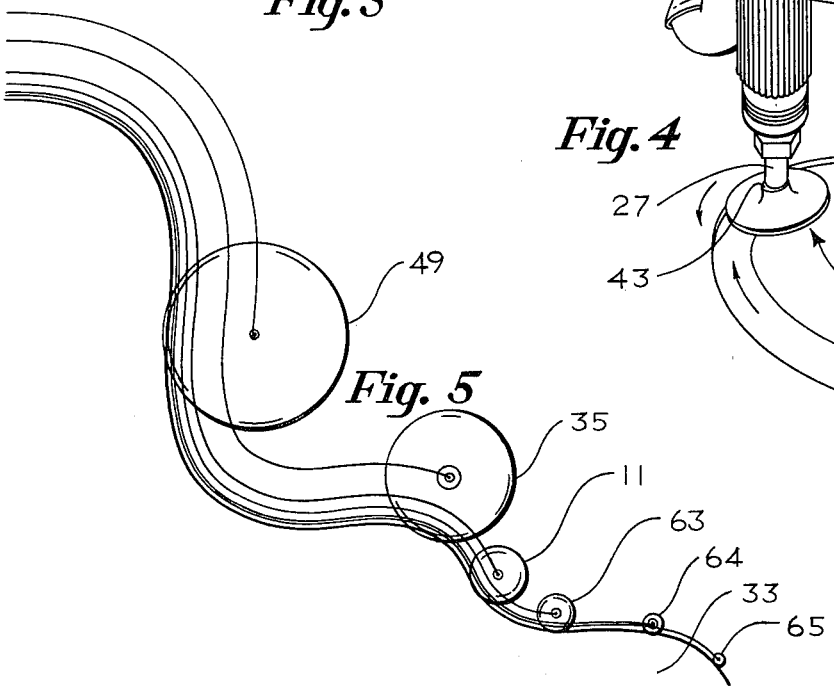
FIG. 5 is a top plan view showing five guides constructed in accordance with this invention, and of different sizes.

While drawing, the circular outer surface 51 will be in rolling contact with template 33, and top 49 will be in sliding contact with collar 27. Part of tip 29 will be in sliding contact with the upper edge of passage 61. The transparency of guide 49 aids in completing a circumferential line, as shown in FIG. 6, by disclosing to the draftsman the initiating point as he nears it. FIG. 5 illustrates six different diameter guides, including additional small diameter guides 63, 64, and 65, and how they have been successively used to draw six parallel lines to an irregularly shaped template 33.

It should be apparent that an invention having significant advantages has been provided. The guide allows a draftsman to make parallel curved lines without the necessity of first drawing them in pencil. The enlarged diameter axial passages provide a tilt to lift the bottom surface from the paper, avoiding smearing of the ink as the line is being drawn. The grooved outer surface with the larger diameter guides serves to prevent the guides from disengagement with the template. The guides are simple in construction and may be used with most conventional drawing pens.

While the invention has been shown in only three of its forms, it should be apparent to those skilled in the art that it is not so limited but is susceptible to various changes and modifications thereof.

I claim:

1. A device for drawing parallel, curved ink lines with a template comprising in combination:

a drafting pen of the type having a tubular tip depending downwardly from a collar;

a guide having an axial passage for receiving the tip, an outer surface concentric with the passage for rolling contact with the edge of the template, a top and a bottom, the axial passage being larger in diameter than the tip to allow the guide to tilt as the guide is pressed against the template to avoid contact of the bottom with the ink while wet;

the height of the guide being selected so that the top will be in sliding contact with the collar to limit the amount of tilt as the guide is moved about the template;

the portion of the outer surface that contacts the template being a frustum of a cone, being larger at the bottom than at the top.

2. The device according to claim 1 wherein the passage has a tapered lower portion that diverges toward a larger diameter at the bottom, the tapered lower portion being parallel with the frustum.

3. The device according to claim 1 wherein the passage has a tapered lower portion that diverges toward a larger diameter at the bottom, and a tapered upper portion that converges toward a small diameter at the intersection with the lower portion, the tapered lower portion being parallel with the frustum.

4. A device for aiding in drawing parallel, curved ink lines with a template and a drafting pen of the type having a tubular tip depending downwardly from a collar, comprising:

a guide having an axial passage for receiving the tip, an outer surface for rolling contact with the edge of the template, a top and a bottom, the axial passage being larger in diameter than the tip and having a lower portion that is tapered and diverges to a larger diameter at the bottom, the portion of the outer surface that contacts the template being a frustum of a cone with a taper substantially equal to the lower portion of the passage, so that when the guide is pressed toward the edge of the template, it tilts to provide parallel contact of the frustum with the edge of the template and parallel contact of the tip with the lower portion of the passage, the height of the guide being selected so that the top will be in sliding contact with the collar when tilted to limit the amount of tilt as the guide is moved about the template.

5. The device according to claim 4 wherein the bottom has a recess bounded by a circular rim at its periphery.

6. A device for drawing parallel, curved ink lines with a template comprising in combination:

a drafting pen of the type having a tubular tip depending downwardly from a collar;

a guide having an axial passage and an outer surface concentric with the passage for rolling contact with the edge of the template, a top and a bottom, the axial passage being larger in diameter than the tip to allow the guide to tilt as the guide is pressed toward the template, the height of the guide being selected so that the top will be in sliding contact with the collar to limit the amount of tilt as the guide is moved about the template, the outer surface having a circumferential groove to retain the edge of the template, the bottom having a recess bounded by a circular rim;

the axial passage having a conical portion with a larger diameter at its lower end than at its upper end.

7. A device for drawing parallel, curved ink lines with a template comprising in combination:

a drafting pen of the type having a tubular tip depending downwardly from a collar;

a guide having an axial passage for receiving the tip, an outer surface concentric with the passage for rolling contact with the edge of the template, a top and a bottom, the passage being larger in diameter than the tip to allow the guide to tilt as the guide is pressed against the template to avoid contact of the bottom with the ink while wet;

the height of the guide being selected so that the top will be in sliding contact with the collar to limit the amount of tilt as the guide is moved about the template;

the passage having a conical portion with a larger diameter at its lower end than at its upper end.

* * * * *